US006575883B1

(12) United States Patent
Hinds

(10) Patent No.: US 6,575,883 B1
(45) Date of Patent: Jun. 10, 2003

(54) EXERCISE WHEEL ASSEMBLY

(76) Inventor: Robert Sylvester Hinds, 1803 Regent St., Madison, WI (US) 53705

( * ) Notice: Subject to any disclaimer, the term of this patent is extended or adjusted under 35 U.S.C. 154(b) by 0 days.

(21) Appl. No.: 10/138,441

(22) Filed: May 3, 2002

(51) Int. Cl.[7] ..... A63B 21/00
(52) U.S. Cl. ..... 482/132; 482/125
(58) Field of Search ..... 482/125, 124, 482/105, 132, 907, 140, 145; 36/131, 11.5

(56) References Cited

U.S. PATENT DOCUMENTS 3,403,906 A 10/1968 Burzenski
3,580,569 A 5/1971 Wilson
3,978,596 A * 9/1976 Brown et al. ..... 36/11
4,595,197 A 6/1986 Hagstrom et al.
4,856,211 A 8/1989 Phillips
5,176,595 A 1/1993 Lind
5,509,831 A 4/1996 Gelbart
5,816,818 A 10/1998 Wun
6,053,853 A 4/2000 Hinds
6,328,680 B1 * 12/2001 Shifferaw ..... 482/132

* cited by examiner

*Primary Examiner*—Jerome W. Donnelly
(74) *Attorney, Agent, or Firm*—Loyd W. Bonneville

(57) ABSTRACT

A wheel and axle exercising assembly with which the operator is positioned horizontally, either face up or face down and moves the assembly forward and backward either feet first, having the feet at the assembly, by thrusting the legs forward and then retracting them; or hands first, having the hands at the assembly, by thrusting the arms forward and then retracting them. Adjustment means are present to position the foot emplacement assemblies either closer to or farther from the wheel.

13 Claims, 4 Drawing Sheets

EXERCISE WHEEL ASSEMBLY

BACKGROUND OF THE INVENTION

1. Field of the Invention

Exercise Equipment

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term foot engaging elastic ring (40) might be used in one instance but in another, if meaning is otherwise clear from context, expression might be shortened to elastic ring (40) or merely ring (40). Any of those forms is intended to convey the same meaning.

The term attach or fasten or any of their forms when so used means that the juncture is of a more or less permanent nature, such as might be accomplished by nails, screws, welds or adhesives. Thus it is stated herein that the connection of the axle cradle (27) to the footrest (20) is one of attachment, for which purpose molded one-piece construction is typically employed. A connection in which one object is easily removed from another is described by the word emplace, as where it is stated herein that in some instances, the foot engaging elastic ring's mid-portion (41) is emplaced beneath the footrest (20), partially encircling the heel of the operator's (100) foot. A connection in which two objects, though not attached, could be separated only with considerable difficulty is referred to herein as one of rigid emplacement. The fastening of the footrest (20) to the axle (11) by means of interior adjustable tubular screws (23) is stated herein to be such a connection. Employment of the words connector join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that the foot engaging elastic ring (40) comprises a stretchable loop present to provide a secure connection of the operator's (100) foot to the footrest (20). The term comprise may also be characterized by what might be considered one-way equivalency, as when it is stated herein that the elastic ring's (40) emplacement beneath the footrest (20) merely comprises the ring's (40) underlying the axle (11), meaning that in the given instance, that disposition is itself the type of emplacement employed. This use of the word has a generic sense to it. That is, the ring's (40) underlying of the axle (11) will always be an emplacement but emplacement may be the underlying of the axle (11) in one case but something else in another. However, the word comprise may also be used to describe a feature which is part of the structure or composition of a given object. Thus, each foot emplacement assembly is stated to comprise, among other things, a footrest (20) as a component thereof. The meaning in the respective cases is clear from context, however. Accordingly, modifying words to clarify which of the three uses is the intended one seem unnecessary.

Terms relating to physical orientation such as top or bottom, upper or lower, refer to the positioning of the assembly in the manner it would be observed during a commonly practiced mode of operation. This convention has been adopted as a matter of convenience in discussing orientation and as shown in the drawings. Thus, the operator's (100) feet are said to be stationed upon the footrest's top (21) and the axle (11) is considered to underlie the footrest (20). For such a spacial relationship, it is assumed that the operator (100), in a feet forward mode of exercise is postured face upward as shown in FIG. 1. The use of the terms in this manner must, of course, be interpreted so as to be equally understood regardless of what attitude the assembly is positioned—such as, for example, if it were inverted so that the operator's posture is face down. In such instances, it is necessary to specifically qualify what is meant by such recitations as on top of or beneath. The very expression feet forward or hands forward, ante, when referring to alternative modes of exercise is a fitting example of the use of those terms of orientation herein.

The word longitudinal and derivations thereof refer merely to the longest dimension of a given object, provided it has one. Thus, it is stated herein that the elastic ring's first and second ends (42, 43, respectively) are disposed in longitudinal opposition to one another (42, 43). This merely means that as the ring's mid-portion (41) is emplaced beneath the footrest (20), the elongated shape extends both forward and rearward with respect to the operator's (100) foot.

The term reeve, or any of various forms thereof, is occasionally employed herein. It is stated, for example, that each foot-strap (31) is reeved through the foot-strap slots (30) or as otherwise expressed, disposed for emplacement at the foremost part of the footrest (20) by enreevement through the slots (30). This merely means that it (31) is inserted, strung or threaded in the familiar manner. Enreevement may be through a singular appropriate opening, of course, but where more than one is present—as in the case of the openings on the buckle (32)—passage is through first one slot (30) and then, the other (30). The same meaning applies in that instance.

In some cases, the same word expressed as a noun is also used for a verb. Thus, it is stated, for example, that the axle cradle (27) preferably comprises an axle tunnel (28), which is the opening through which the axle (11) passes. Yet, it is also stated that the interior adjustable tubular screws (23) used for fastening the footrest (20) to the axle (11) tunnel through the axle cradle and impinge it (11). The propriety of this divergent use of the term is established by the dictionary. Occasionally, however, certain words may be coined herein to simplify discussion by interchanging noun, verb or adjective or by modifying certain words. For example, coengage and interthread are terms occasionally applied to describe the relationship of objects brought into conjunction with one another in a particular way—by threading, by the buttressing of one against the other for an intended purpose or by some other mutual interrelationship.

The manual operation of a wheel and axle upon an underlying surface (200) by an operator (100) occupying a horizontal position has become an increasingly popular mode of exercise. The operator (100) may be oriented either feet first, in which case the part of the body most proximate the apparatus is the feet—or hands first—in which case, it is the hands. In either case, the operator (100) may be postured either face up or face down. When operating face up in the feet first mode, for example, either the operator's (100) back, the head and shoulders or merely the forearms may rest upon the underlying surface (200). If the exercise is feet first and face down, a part of the thorax or merely the hands in pushup fashion may rest upon it (200). In hands first mode, face down mode, the thorax or merely the lower legs or even the toes may rest upon it (200). Hands first, face up exercises present a special challenge and variations in chosen postures would, of course, be possible for the imaginative. Any of these horizontal exercises, though sometimes difficult for the novice to perform, result in considerable benefit to the body.

It has been observed also that in feet forward modes of operation, different sets of leg and lower body muscles are focused upon depending upon the particular operator (100) and the lateral placement of the feet with respect to the wheel. Thus far, little attention had been given to this aspect of the matter in that footrests have often been attached in place a predetermined distance from the wheel.

Relevant historical development appears to have begun with the vertically oriented unicycle. More recent of variations on that structure are shown in U.S. Pat. No. 3,580,569 issued to Wilson; U.S. Pat. No. 5,509,831 issued to Gelbart; and U.S. Pat. No. 5,816,818 issued to Wun. The first and last of those comprised elaborate supporting frames. The latter illustrated a water flotation mechanism which employed miniature hook and loop straps attached to foot pedals.

U.S. Pat. No. 3,403,906 issued to Burzenski comprised a hands forward assembly in which it appears handgrips rotated upon an axle attached to the wheel. It also included a paired wheel version. U.S. Pat. No. 4,595,197 issued to Hagstrom, eta, and U.S. Pat. Nos. 5,004,229 and 5,176,595 issued to Lind all featured opposing paired wheel exercise assemblies which, while including means to adjust the footrests laterally upon the axle, lacked the tilting or canting advantages of a single wheeled version operable along a curved path.

U.S. Pat. No. 4,856,211 issued to Phillips featured miniature hook and loop foot strapping, the first part of which partially encircled the front of the foot and the second attached frontally to the first through a short elastic sector disposed laterally to the metatarsal and then extended backward to partially encircle the operator's (100) heel.

In comprising singular wheel—that is, a unicycle type—construction for the horizontal postures, thereby making canted operation feasible, U.S. Pat. No. 6,053,853 issued to Hinds, though absent hands forward modes of operation and means for lateral footrest adjustment upon the axle, represented a departure in such respects from all of the foregoing line except Burzenski. The Hinds apparatus differed from that of Burzenski, however, in permitting the wheel to rotate upon the axle.

What is needed is an exercise wheel assembly which, while providing efficient rotation of the axle within the hub of the wheel instead of the handholds and the capability to cant the wheel in exercise, eliminates cumbersome components from the footrest assembly, features a simple adjustment mechanism for optimum lateral placement of the operator's (100) feet and, most importantly, permits alternatively selected hands forward or feet forward modes of operation.

SUMMARY OF THE INVENTION

The invention is an exercise assembly comprising a wheel and axle assembly (1)—in which the wheel (10) rotates upon the axle (11)—and an opposing pair of foot emplacement assemblies (2), the footrest (20) of which (2) is connected to the axle (11) preferably by means of rigid emplacement. The exercise assembly may be employed in either a feet forward or hands forward manner and the operator (100) may be positioned in either a face up or face down posture. The wheel (10) may be canted in operation to permit it (10) to trace out a curved path required for certain exercises.

For feet first operation, each foot emplacement assembly comprises a generally plane shaped footrest (20) upon the top of which (21) the operator's (100) feet are stationed. In face down usage, the footrest top (21) would, of course, be inverted downward. It is the footrest's underside (22) which is connected to the axle (11) either directly or through an axle cradle (27)—an intervening object which provides a spacer-like character convenient for certain assembly arrangements. The connection is such as to permit adjustment of position laterally upon the axle (11) to address the needs of the particular operator (100).

The foot emplacement assembly (2) also comprises a foot engaging elastic ring (40) which connects the operator's (100) feet to the footrest (20). The ring (40) may conveniently be created from hollow elastic exercise cord (400).

The elastic ring (40), the second end of which (43) secures the back of the operator's (100) foot by partially encircling it, is run along the footrest's underside (22) and anchored at the front in any one of several alternative ways. On the one hand, it (40) may have its first end (42) partially encircle the front of the operator's (100) foot. On the other, it (40) may have its first end (42) secured upon some part of the footrest's underside (22), in which case, a pair of opposing foot-strap slots (30), a foot-strap (31) and buckle (32) are provided to secure the foot at the front. A fitting example of a frontal securing site is a ring anchoring notch (25) disposed at the forward part of each axle cradle (27).

A preferable manner in which the ring (40) is frontally secured beneath the footrest (20) at the ring anchoring notch (25) is to run the ring (40) around the exterior of the opposing cradles (27) and through a relatively narrow emplacement recess (29) created by the proximity of a restraining ridge (26) disposed along the sides of the footrest (20). To avoid the cord's (40) dislodgment, the recess (29) should be narrow enough to require stretching and squeezing it (40) into place within.

A pair of opposing cushioned grip sleeves (14) are preferably disposed upon respective ends of the axle (11) for hands forward operation. Incidental hardware for the assembly includes opposing wheel restraining lock-rings (12) disposed by attachment upon the axle (11) at a site very near the wheel (10) to secure it in place during rotation.

BRIEF DESCRIPTION OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention.

FIGS. 7, 8, 11 and 12 exhibit emplacements in which the ring's first end (42) are intended to be brought over the front of the operator's (100) foot. FIGS. 9, 10, 13 and 14 feature anchoring at the footrest's ring anchoring notch (25) disposed at the foremost part of the axle cradle (27).

DESCRIPTION OF THE PREFERRED EMBODIMENT

Figure 1:
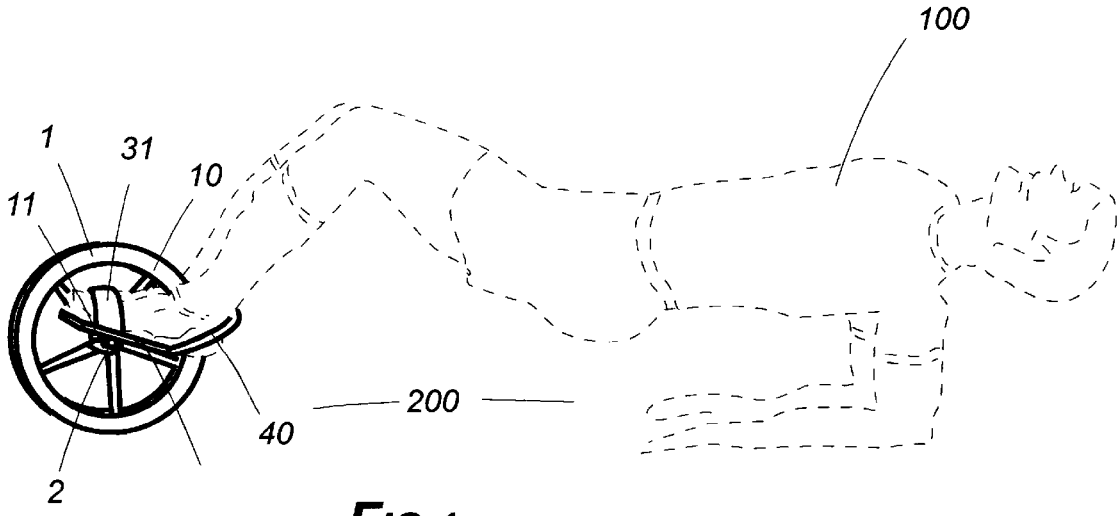
FIG. 1 illustrates a popular use of the assembly by an operator (100).
Figure 2:
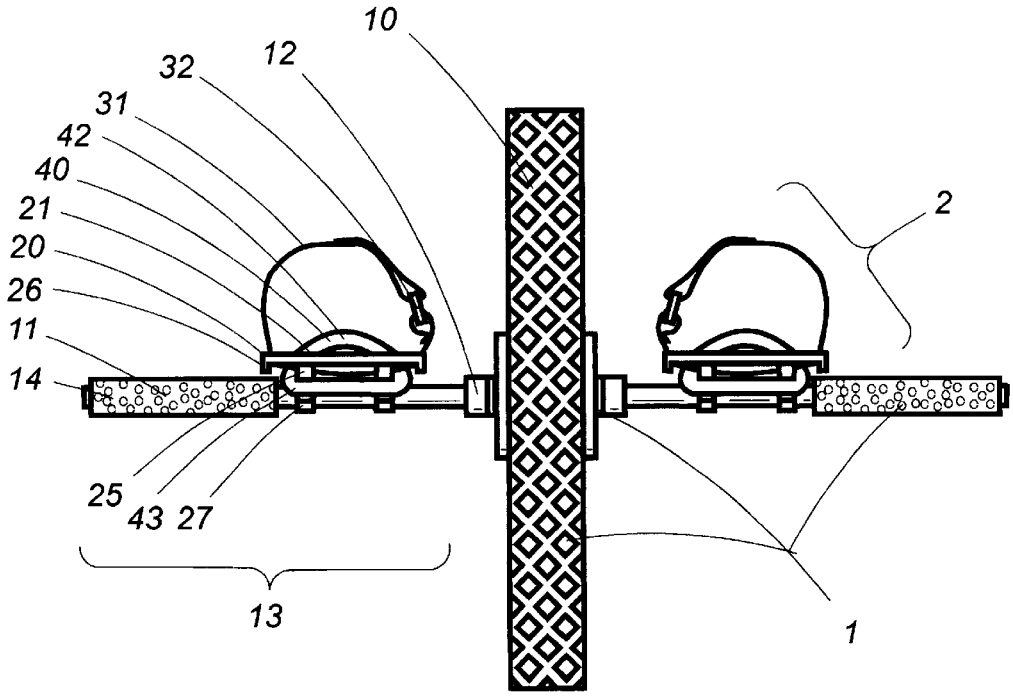
FIG. 2 represents a straight-on view of a typical embodiment of the assembly from the front.
Figure 3:
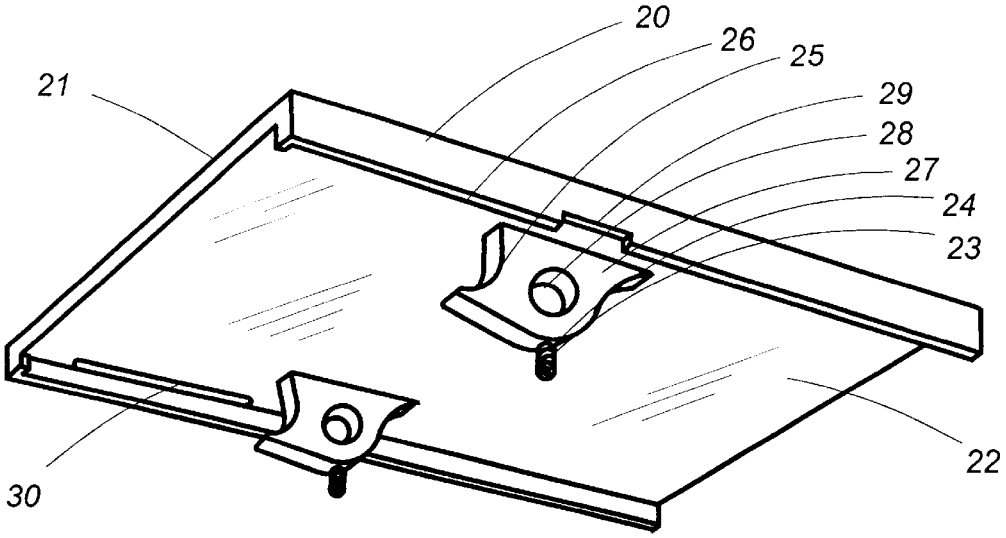
FIG. 3 comprises a perspective view of just the footrest (20).

The subject of this application is an exercise wheel assembly comprising as part of a combination a simplified but considerably improved mechanism for the operator's (100) feet. Included features permit employment of the assembly in either hands forward or feet forward manner, efficient rotation of the wheel upon the axle, adjustment in lateral placement of the opposing footrest assemblies and, as well, single wheeled canted operation in which a curved path is traced out for certain exercises.

The invention comprises a wheel and axle assembly (1) and a pair of foot emplacement assemblies (2). The former (1) comprises a wheel (10) and an axle (11) rotationally disposed upon it (10). By this is meant that the wheel (10) freely spins or rotates upon the axle (11) during the assembly's (1) forward and backward movement upon the underlying surface (200) in projection and retraction. The axle itself (11) is, therefore, stated herein to be a non-rotating member. It is also described as being disposed axially at the wheel's (10) center, meaning merely that it penetrates the wheel (10) at the center of its (10) radial plane in the familiar manner and as illustrated in the drawings. Preferably, means to prevent the wheel (10) from moving laterally upon the axle (11) during use are also provided, ante. The perimeter of the wheel itself (10) may either be solid or of inflated tubular structure and the more interior portion may comprise radial spokes in the traditional manner. Experience demonstrates that it (10) preferably comprises a diameter of between six and 15 inches.

The two foot emplacement assemblies (2) present—one for each of the operator's (100) feet—are disposed upon the axle (11) in opposition to one another with respect to the wheel (10). Thus, one of them (2) is situated to one side of the wheel's (10) radial plane and the other (2), the opposite side. engaging elastic ring (40).

Each footrest (20) comprises the generally planular configuration shown in the drawings. The operator (100) positions his or her feet upon its top (21). Each footrest's underside (22) is disposed to overlie the axle (11) and is connected to it (11), preferably through one or more intervening axle cradles (27), preferably two (27) which are laterally and opposingly disposed. Each cradle (27) may conveniently be formed integrally to the footrest (20)—such as by one-piece molding—rather than attached as a separate article. When present, each (27) preferably comprises an axle tunnel (28) which is penetrated by the non-rotating axle (11), thereby providing a convenient connection site to it (11).

While each footrest (20) may simply be attached directly to the axle (11) at a predetermined distance from the wheel (10), it is preferable to employ the type of connection depicted in the drawings, wherein interior adjustable tubular screws (23) for which adjustment is required by a tubular screw adjusting wrench (300)—sometimes referred to as an L-shaped wrench-penetrate part of the footrest (20) or, if present, the axle cradle (27) and impinge the axle (11). This type of connection permits the footrest (20) to be slid laterally along the axle (11) to a selected position, thereby creating a zone of lateral footrest adjustment (13) alluded to supra. In keeping with the definitions herein, supra, the connection of the foot emplacement assembly (2) to the axle (11) may, then, be properly characterized as one of rigid attachment whether actually made directly through the footrest (20) or indirectly through one or more axle cradles (27) present.

The foot engaging elastic ring (40) comprises a stretchable loop present to provide a secure connection of the operator's (100) foot to the footrest (20).

Figure 6:
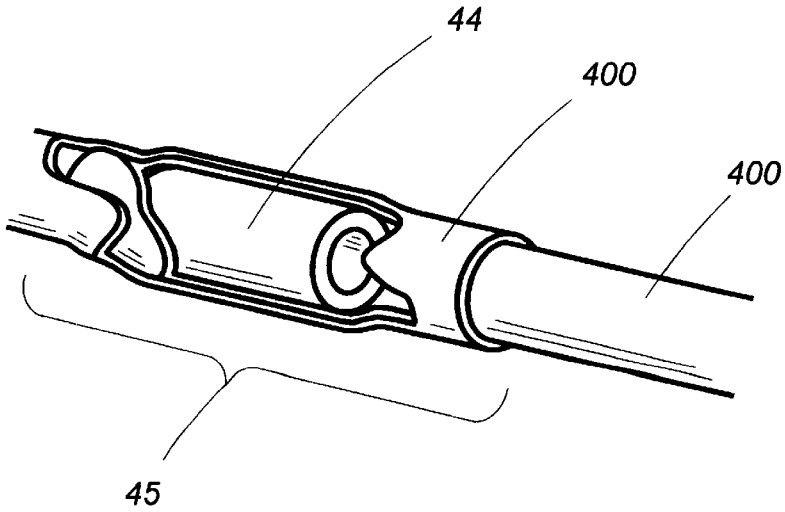
FIG. 6 comprises a cut-away view of a ring closing connection (45) formed by bringing the ends of a segment of hollow elastic cord (400) together in a particular manner in which an impinging plug (401) is embedded within the innermost of them.
Figure 7:
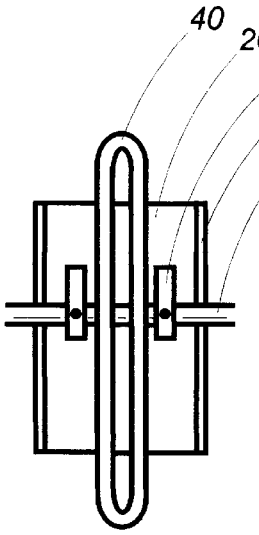
FIGS. 7–14 feature several types of elastic ring (40) emplacement beneath the footrest (20).
Figure 8:
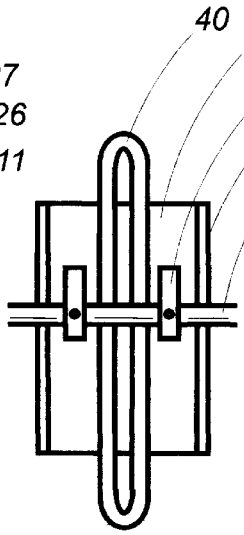
Figure 9:
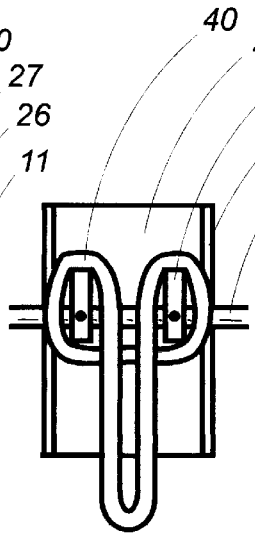
Figure 10:
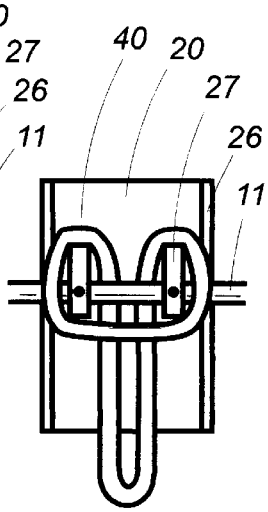
Figure 11:
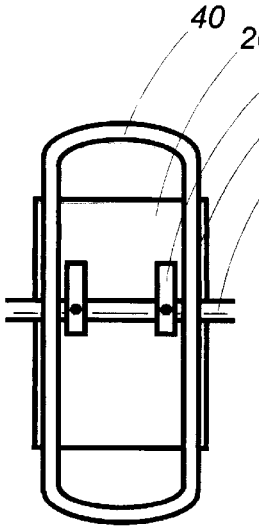
Figure 12:
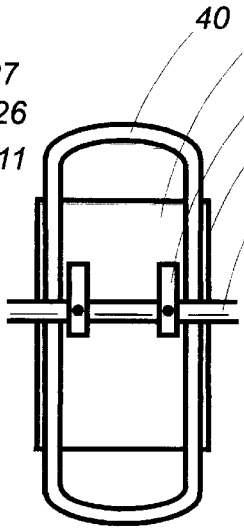
Figure 13:
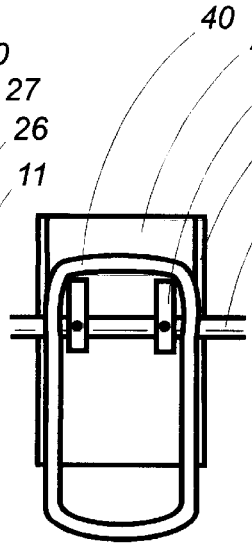
Figure 14:
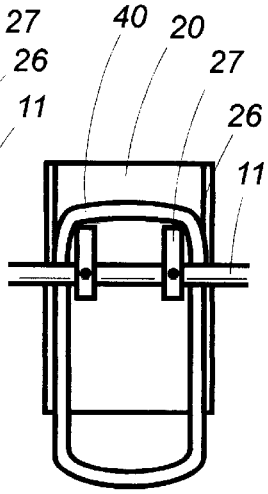

The ring (40) comprises a mid-portion (41), a first end (42) and a second end (43) longitudinally opposed to the first (42). Preferably, it (40) comprises a length of hollow elastic cord (400), so often currently employed in various ways with exercise equipment. A special method of forming a feasible loop becomes quickly apparent to those familiar with the cord's (400) use. It has become quite a common practice, for instance, to insert an impinging plug (401) into the end of the cord (400) to provide a stop so that the cord (400) cannot inadvertently be pulled through a given aperture. To form the ring (40)—that is, to provide a ring closing connection (45)—it is merely necessary to insert the end of the cord (400) containing the plug (401) into the cord's (400) opposite end. The construction is illustrated in FIG. 6. While some dexterity and patience might be required to accomplish this task manually, manufacturing gadgets and processes are available to accomplish the task easily. The segment of cord (400) employed to form the ring (40) may, of course, be of any desired length. Other types of ring closing connections are feasible, of course, such as might be accomplished directly in manufacture by vulcanization or other heat molding process. Yet, the advantage in creating one's own ring (40) from hollow cord (400) is that the ring's (40) length can be modified for one or another of the various types of emplacement possible, ante.

One can visualize different variations in the foot emplacement assembly's (2) structure. In all usages considered, however, the foot engaging elastic ring's second end (43) is caused to partially encircle the back of the operator's (100) foot above the heel. The remainder of the ring (40) may be twisted—or crossed—to facilitate any type of emplacement. Its first end (42) must, of course, be secured in some manner and this is spoken of herein as frontal anchoring. Several examples are provided in FIGS. 7–14.

Beneath the footrest (20), the remainder of the ring (40) may be emplaced to underlie the axle (11), its first end (42) merely stretched around and over the front part of the footrest (20) across the front top—the toes and metatarsal—of the operator's (100) foot. One can readily see that when the elastic ring (40) is emplaced to underlie the axle (11) in this manner, an axle cradle (27) is unnecessary. The footrest (20) may merely be directly attached to the non-rotating axle (11).

Frontal anchoring across the top of the operator's (100) foot might be well recognized by some who as a child cut cross-sectional slices from an old-fashioned automobile innertube—thereby extracting an elastic band—and encircling the toe and heel as a makeshift ski binding. A mid-portion of the band was caused to pass through a part of the ski strap-by crossing or otherwise—to secure the foot to the ski. As we know, ski boots and metal bindings ultimately emerged to fulfill that need. While it is tempting to characterize the improvised innertube ring as prior art, it appears that the foot engaging elastic ring (40) hereof, when similarly employed, is more properly considered revival of an ancient art.

If frontal anchoring across the top of the operator's (100) foot is not undertaken, some other forward disposed anchor for the ring (40) will, nevertheless, be required. One or more attached pegs or hooks at a desired anchoring site would do. As it happens, a portion of an axle cradle (27), if one (27) is present, provides a convenient site for the sought after anchor, that portion herein designated as the ring anchoring notch (25).

Figure 4:
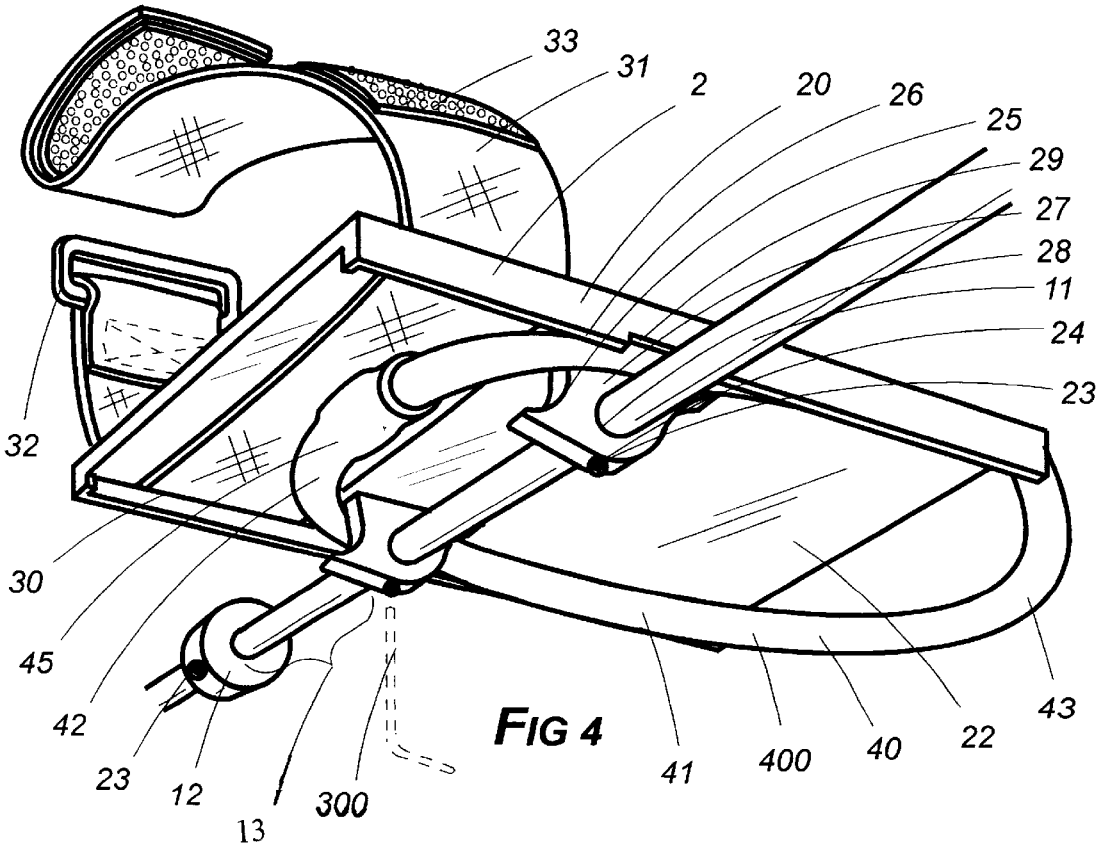
FIG. 4 depicts the entire foot emplacement assembly (2), this embodiment comprising a foot-strap (31) with accompanying buckle (32) and featuring a segment with miniature hook and loop interdoubling composition (33). The foot engaging ring (40) incidentally displaying a ring closing connection (45) is presented in its preferred emplacement. A tubular screw adjusting wrench (300) is also shown in position for tightening the axle cradle's (27) connection to the axle (11).
Figure 5:
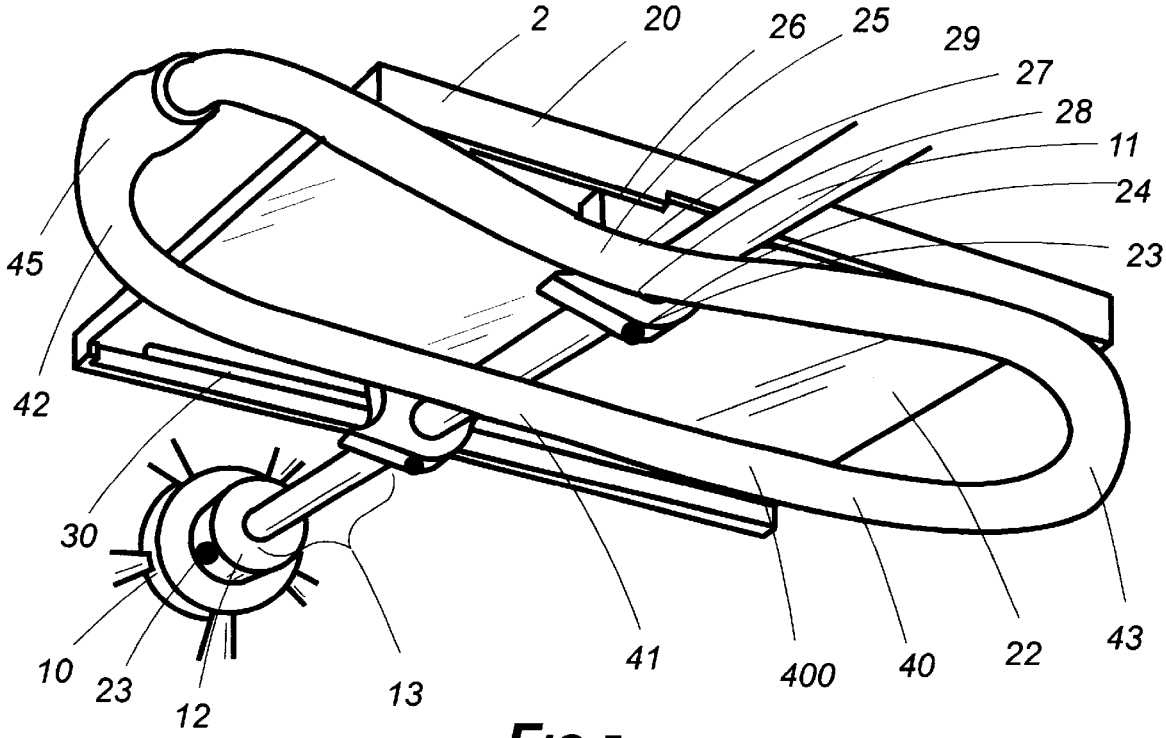
FIG. 5 illustrates the elastic ring (40) emplaced in a manner in which its first end (42) will partially encircle the top front of the operator's (100) foot. In this case, the emplacement beneath the footrest (20) merely comprises the ring's (40) underlying the axle (11) in its (40) entirety.

Moreover, in instances in which frontal anchoring of the ring (40) is other than across the top of the operator's (100) foot, some means must yet be provided to secure the foot. Accordingly, a foot-strap (31) and laterally opposing foot-strap slots (30) may be included as part of the footrest's (20) structure. The mid-portion of each strap (31), when present, is disposed beneath the footrest (20), the ends thereof (31) reeved through the slots (30) and extending upwards above the footrest (20). A foot-strap buckle (32) is disposed upon one of its (31) ends. The buckle (32), of course, comprises dimension such that it cannot pass through either of the slots (30); and, therefore, the reeving of the strap (31) must always be accomplished with the non-buckled end thereof (31). The buckled end of the strap (31) is reeved through the buckle (32), looped and attached back upon itself—ordinarily by stitch-work. In use, the non-buckled end is also reeved through part of the buckle (32), looped and doubled back upon itself to close the strap upon the operator's (100) foot. For its fastening character, the face of this end of the strap (31) preferably comprises a sector of miniature hook and loop interdoubling composition (33). This familiar arrangement is illustrated in FIG. 4. Other buckling arrangements are known which might likewise be employed. Like many other parts of the assembly, no inventiveness is claimed in the strap (31) or buckle (32) themselves in this embodiment since they are merely part of the entire combination.

One can also readily see that whenever frontal anchoring across the top of the operator's (100) foot is employed, in whatever manner the elastic ring (40) might otherwise be run beneath the footrest (20), the ring anchoring notch (25), foot-strap slots (30), foot-strap (31) and buckle (32) become just as unnecessary as the cradle (27).

However, the portion of the elastic ring other than its second end (43)—the mid-portion (41) and first end—need not necessarily be extended to underlie the axle (11). So long as a space beneath the footrest (20) is present to permit doing so, that portion of the ring (40) may be routed through between the axle (11) and footrest (20) with the its first end (42) stretched—crossed or uncrossed—to occupy either of the positions discussed just supra. The inclusion of two or more axle cradles (27) as part of the structure provides such a space. Even here, however, two variations are possible.

The ring (40) may be routed through the medial space between two opposing cradles (27) or, alternatively, around their (27) exteriors. In the latter configuration, it is preferable to also dispose beneath the footrest (20) an opposing pair of restraining ridges (26), each sufficiently near the cradle (27) to make it difficult for the ring (40) to be pulled loose. To emplace the ring (40) within the small gap thus provided—identified herein as an emplacement recess (29), it is merely necessary to stretch it (40) to narrow a segment of its (40) cross-sectional diameter so that it (40) can be pulled into place. Narrowing the recess (29) provides a grip on the ring (40) strong enough also to prevent its (40) slipping forward or backward. Therefore, it is preferable to include as part of structure an opposing pair of longitudinally disposed restraining ridges (26) and accompanying emplacement recesses (29).

It would, of course, be wise to include as part of any embodiment of the structure the foot-strap slots (30), foot-strap (31), buckle (32) and axle cradle (27) with its ring anchoring notch (25) so that the assembly might be used in any of the foregoing manners described.

Two opposing wheel restraining lock-rings (12) are oppositely disposed circumferentially upon the axle (11) and with reference to the wheel (10)—one thereof (12) to each side—to prevent it (10) from sliding laterally upon the axle (11) during the assembly's forward and backward motion upon an underlying surface (200) in projection and retraction. The lock-rings (12) are attached in place to the axle (11), preferably buttressing the wheel (10)—that is, disposed immediately adjacent it (10)—but allowing sufficient space for its (10) free rotation upon the axle (11). Experience demonstrates the lack of necessity for special contact surfaces such as ball bearings for the assembly. Attachment of the lock-rings (12) to the axle (11) may be of any sort but for the sake of packaging and disassembly, it is preferably accomplished by fastening interior adjustable tubular screws (23) into threaded apertures (24) provided for the purpose.

Cushioned grip sleeves (14) are preferably disposed at the ends of the axle (11) so that the operator (100) might employ the assembly in a hands forward mode of operation in which the feet or the knees rest upon the underlying surface (200).

What is claimed is:

1. An exercise wheel assembly comprising a wheel and axle assembly; and a pair of foot emplacement assemblies;

the wheel and axle assembly comprising a wheel and an axle rotationally disposed axially at the wheel's center;

each of the foot emplacement assemblies disposed upon the axle in opposition to one another with respect to the wheel, and comprising a footrest connected to the axle; and a foot engaging elastic ring in turn comprising a mid-portion and first and second longitudinally opposing end portions;

wherein the mid-portion is disposed by emplacement beneath the footrest, the first end of the ring is anchored and the second end thereof is stretched to partially enwrap the operator's heel; thereby securing the feet above and upon the footrest;

whereby an operator may, upon emplacing each of his or her feet upon a respective footrest and within the foot engaging ring, engage in a number of selected exercises wherein the hands are held rigidly against the underlying surface and the assembly is alternatively projected and retracted to exercise certain muscles.

2. The exercise wheel assembly according to claim 1 wherein the footrest is configured to comprise an anchoring notch disposed upon its underside, wherein the anchoring of the foot engaging elastic ring's first end comprises emplacing it to engage the notch;

laterally opposing foot-strap slots; and a buckled foot-strap disposed for emplacment at the foremost part by enreevement through the slots.

3. The exercise wheel assembly according to claim 1 further comprising one or more axle cradles disposed beneath the footrest so as to provide a connecting site for the axle.

4. The exercise wheel assembly according to claim 1 comprising opposing wheel restraining lock-rings circumferentially disposed upon the axle to prevent the wheel's lateral movement upon it.

5. The exercise wheel assembly according to claim 1 further comprising opposing cushioned grip sleeves each disposed upon a respective end of the axle; whereby an operator may, upon grasping the axle with his or her hands, engage in a number of selected exercises wherein the feet, knees or torso rest upon the underlying surface and the assembly is alternatively projected and retracted to exercise certain muscles.

6. The exercise wheel assembly according to claim 1 wherein the wheel is inflated.

7. The exercise wheel assembly according to claim 1 wherein the wheel comprises a diameter within a range between six inches and 15 inches.

8. The exercise wheel assembly according to claim 2 wherein the buckled foot-strap comprises a sector of miniature hook and loop inter-doubling composition.

9. The exercise wheel assembly according to claim 2 wherein each footrest is further configured to comprise a pair of opposing restraining ridges and emplacement recesses longitudinally disposed upon its underside wherein the security of the foot engaging elastic ring is enhanced.

10. The exercise wheel assembly according to claim 3 wherein the number of axle cradles is two and their disposition beneath the footrest is laterally opposite one another.

11. The exercise wheel assembly according to claim 3 wherein each axle cradle further comprises an anchoring notch wherein the anchoring of the foot engaging elastic ring's first end comprises emplacing it to engage the notch.

12. The exercise wheel assembly according to claim 3 wherein the axle comprises sufficient elongation so as to comprise a zone of lateral footrest assembly adjustment and the connection of the footrest to the axle is by means of rigid emplacement.

13. The exercise wheel assembly according to claim 12 wherein the means of rigid emplacement for connection of the footrest to the axle comprises interior adjustable tubular screws disposed to tunnel through the axle cradle and impinge the axle.

* * * * *

UNITED STATES PATENT AND TRADEMARK OFFICE
Certificate

Patent No. 6,575,883 B1 Patented: June 10, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Robert Sylvester Hinds, Madison, WI (US); and Jon Harrington Hinds, Madison, WI (US).

Signed and Sealed this Fourteenth Day of January 2014.

LOAN H. THANH
*Supervisory Patent Examiner*
Art Unit 3764
Technology Center 3700